United States Patent [19]

Easterling

[11] 4,071,090

[45] Jan. 31, 1978

[54] MOTORGRADER IMPLEMENT MOUNTING ARRANGEMENT

[75] Inventor: Gene B. Easterling, Decatur, Ill.

[73] Assignee: Caterpillar Tractor Co., Peoria, Ill.

[21] Appl. No.: 715,743

[22] Filed: Aug. 19, 1976

[51] Int. Cl.[2] ..... E02F 3/76

[52] U.S. Cl. ..... 172/788; 172/791

[58] Field of Search ..... 172/788, 791, 792, 793, 172/795, 797, 780, 781

[56] References Cited

U.S. PATENT DOCUMENTS

| | | | |
|---|---|---|---|
| 1,907,807 | 5/1933 | Henneuse | 172/788 |
| 3,027,662 | 4/1962 | Cunningham | 37/180 |
| 3,381,760 | 5/1968 | Brawd | 172/788 |
| 3,463,243 | 8/1969 | Fisher | 172/781 |
| 3,512,589 | 5/1970 | Ulrich | 172/786 |
| 3,677,350 | 7/1972 | Johnson | 172/789 |
| 3,739,861 | 6/1973 | Johnson | 172/793 |
| 3,976,146 | 8/1976 | Desourdy | 172/788 |
| 3,983,945 | 10/1976 | Hart | 172/788 |

FOREIGN PATENT DOCUMENTS

| | | | |
|---|---|---|---|
| 138,511 | 8/1950 | Australia | 172/788 |

*Primary Examiner*—Richard J. Johnson
*Attorney, Agent, or Firm*—Charles E. Lanchantin, Jr.

[57] ABSTRACT

An implement mounting arrangement is disclosed which is operatively associated with a longitudinally oriented main frame of a vehicle such as a motor grader. The implement mounting arrangement includes a base frame assembly having an inner end and an outer end and universally secured at its inner end to the main frame, a pair of actuators interconnected between the main frame and the outer end of the base frame assembly for suspended raising, lowering and tilting thereof, an implement support assembly hingedly mounted on the outer end of the base frame assembly, and a pair of actuators interconnected between the base frame assembly and the implement support assembly for angling it relative to the direction of travel of the vehicle.

8 Claims, 4 Drawing Figures

MOTORGRADER IMPLEMENT MOUNTING ARRANGEMENT

BACKGROUND OF THE INVENTION

The present invention is related to an implement mounting arrangement on a vehicle, and more particularly to a base frame assembly which is universally secured to the vehicle and an implement support assembly hingedly mounted on the base frame assembly. Appropriate actuators are secured therebetween to adjust the orientation of the implement support assembly relative to the travel direction of the vehicle.

Heretofore, motor graders have utilized a pull-type drawbar which is universally mounted at its front end to the motor grader frame and is suspended at its rear end by hydraulic jacks. A rotatable support circle is secured to the drawbar and a grader blade is mounted on and below the circle, all in a conventional manner. Advantageously, the rear end of the drawbar is side shiftable to extend the side reaching capability of the blade. Exemplifying the prior art in this area are the following two U.S. Patents, both of which are assigned to the assignee of the present invention, U.S. Pat. Nos.:

3,677,350 issued July 18, 1972 to H. M. Johnson et al 3,739,861 issued June 19, 1973 to H. M. Johnson et al.

While such blade mounting arrangements have proven extremely effective and have met with universal acceptance, customer demand for higher horsepower vehicles and larger load capacity earthmoving blades continues to grow. However, the usual circle for rotatably supporting the blade must be increased in diameter to resist the greatly increased forces which would thereby be encountered. This would result in a marked rise in cost and a decreased operator visibility of the blade. Furthermore, an excessive amount of longitudinal space would be required in order to mount and maneuver the heavier circle arrangement between the front and rear wheels of the vehicle. Since the wheel base of these motor graders is already significantly extended in order to provide the superior dimensional control and fine finishing capabilities of the blade, any significant increase thereof is detrimental to maneuverability of the motor grader.

Moreover, another significant problem is that blade loads are conventionally transferred into the front part of the main frame. Thus, the heavier forces which would be encountered would require that the longitudinally oriented main frame would have to be significantly strengthened from the front portion back to the rear portion thereof, which rear portion is inherently heavier in its construction because it supports the power plant and the driving wheels.

SUMMARY AND OBJECTS OF THE INVENTION

Accordingly, an object of this invention is to overcome the above, briefly described problems by providing an improved heavy duty implement mounting arrangement for a vehicle which is longitudinally compact and yet will permit convenient adjustment of the implement to various working attitudes.

Another object of the invention is to provide such an improved implement mounting arrangement which will more effectively transfer high working forces into the main frame of the vehicle.

Another object of the invention is to provide an implement mounting arrangement of the character described which maintains excellent operator visibility of the implement.

Another object of the invention is to provide an implement mounting arrangement of the aforementioned type having an actuator system for better achieving full positioning of the various elements thereof, and including an extended side reaching capability.

Other objects of the invention, including simplicity of construction, low cost and serviceability, will become more readily apparent upon reference to the accompanying drawings and following description.

DESCRIPTION OF THE PREFERRED EMBODIMENT

Figure 1:
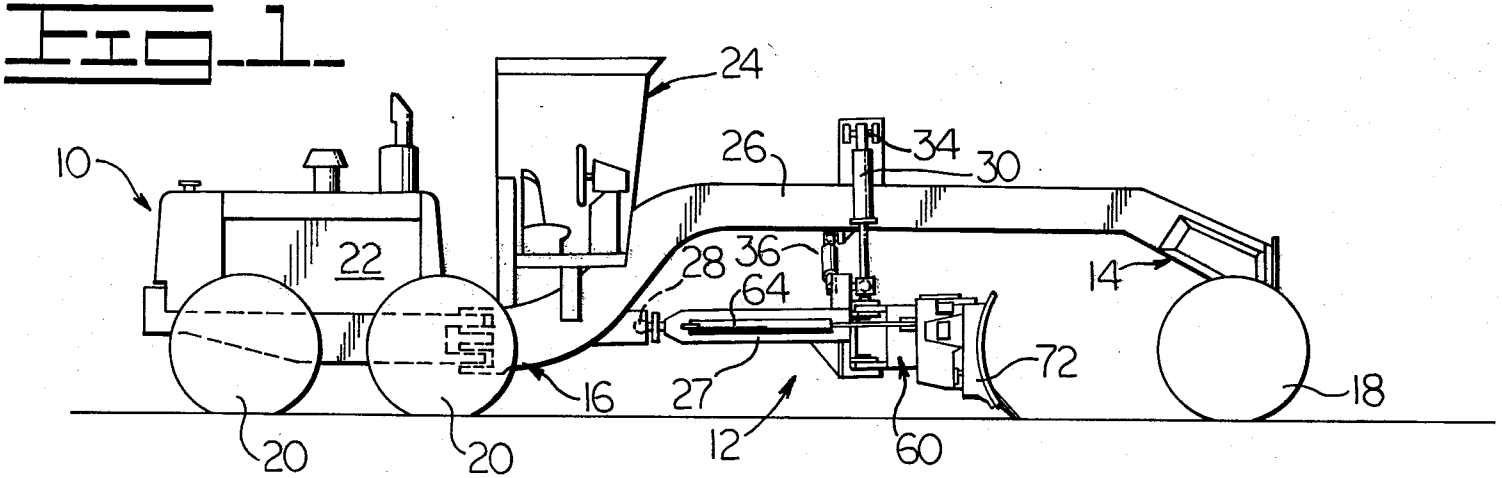
FIG. 1 is a right side elevational view of a motor grader including the implement mounting arrangement of the present invention adapted thereto.
Figure 2:
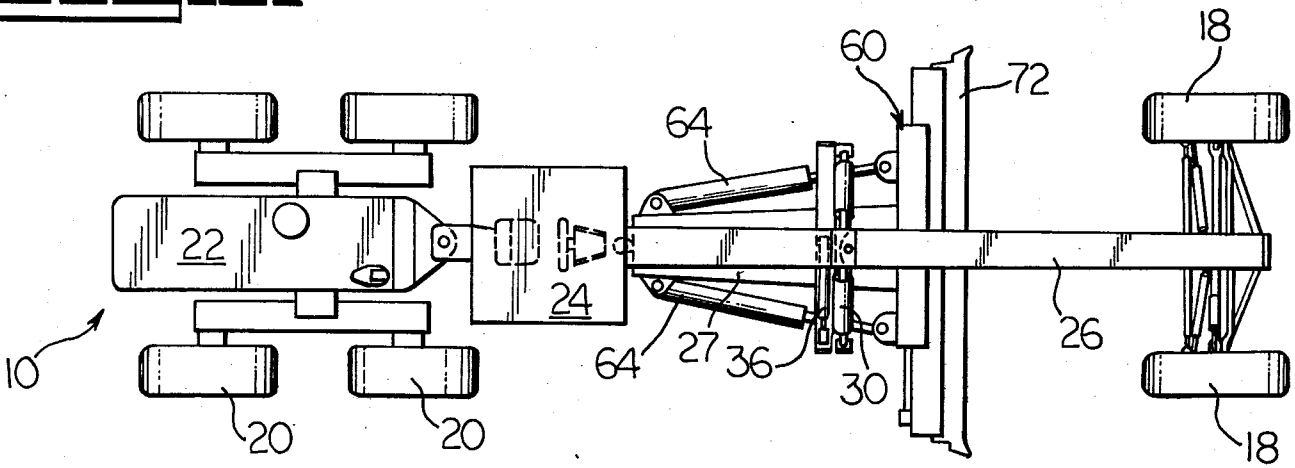
FIG. 2 is a diagrammatic top plan view of the motor grader and the implement mounting arrangement of FIG. 1.

Referring initially to FIGS. 1 and 2, there is shown a vehicle 10, such as a conventional motor grader, with an implement mounting arrangement 12 constructed and arranged in accordance with the present invention between a front portion 14 and a rear portion 16 thereof. The front portion of the motor grader is supported by a pair of steerable wheels 18, while the rear portion is supported by a pair of tandem driving wheels 20. It being understood that the rear portion of the motor grader is of heavier frame construction in order to support a power plant 22 and an operator station 24. As is clearly apparent from the drawings, the front and rear portions of the motor grader are connected by a longitudinally oriented and arcuately spanning main frame 26, and the implement mounting arrangement is suspendingly mounted thereon in such a manner that working forces caused by its forward engagement with the earth are advantageously transmitted primarily rearwardly into the rear portion of the frame.

Thus, in accordance with one feature of the present invention, the implement mounting arrangement 12 includes a base frame assembly or push frame assembly 27 which is supported at its rear end on the main frame 26 through a universal ball and socket connection 28 disposed at the front of the rear portion 16 of the motor grader 10, and generally below the operator's station 24. Moreover, the front end of the assembly is adapted to be pivotally raised, lowered and rocked thereon by a pair of substantially upright actuators or hydraulic lifting jacks 30. As shown best in FIGS. 3 and 4, the lifting jacks are coupled to the push frame assembly through a pair of universal pivot joints 32 and to the main frame by another pair of universal pivot joints 34 symmetrically arranged on the opposite sides of an upstanding bracket 35 extending integrally therefrom. In addition, a centershift actuator or hydraulic stabilizing jack 36 is secured to a universal pivot joint 38 of a bracket 40 welded to the bottom surface of the main frame, and which jack extends generally rightwardly and slightly downwardly to be secured to the push frame assembly 27 as by a universal pivot joint 42.

More particularly, the push frame assembly 27 includes a generally horizontally disposed and longitudinally extending box beam 44 with an inner or rearward end 46 thereof secured to the main frame 26 as by the aforementioned universal connection 28. On the other hand, its outer or forward end 48 includes a transverse cross arm 50 which is integrally secured to an upper surface of the box beam, and to which is further secured a pair of side plates 52 and an upright pair of pivot joint mounting plates 54. Thus, the T-shaped construction thereof provides for securing the lifting jacks 30 to the joints 32 to suspendingly raise, lower and tilt the forward end thereof, and also provides for securing the stabilizing jack 36 transversely to the joint 42.

Figure 3:
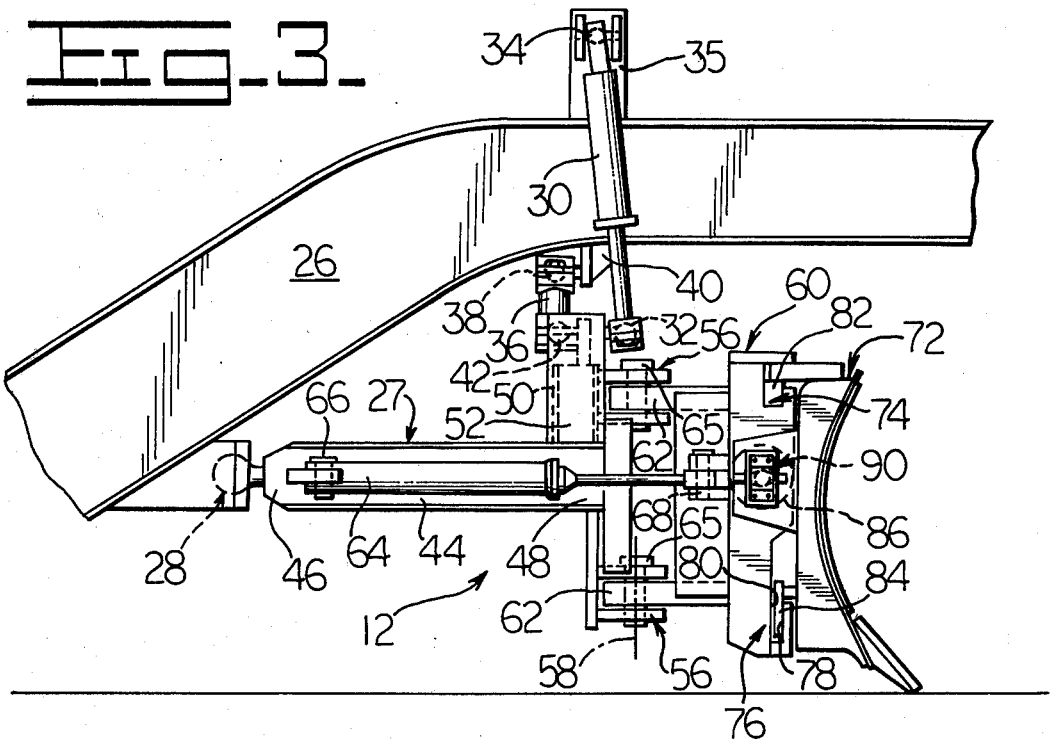
FIG. 3 is an enlarged right side elevational view of a portion of FIG. 1 to better illustrate details of construction of the implement mounting arrangement of the present invention.

In accordance with a major aspect of the invention, and as best shown in FIG. 3, a pair of elevationally spaced apart hinge joints 56 are formed on the forward end 48 of the push frame assembly 27. This provides an upright pivot axis 58 thereon when the implement mounting arrangement 12 is in a substantially horizontal attitude. Advantageously, the implement mounting arrangement also includes an implement support assembly 60 having a pair of rearwardly and generally horizontally extending arms or plate members 62 which are respectively interleaved within the hinge joints. Specifically, suitably aligned openings are defined in the hinge joints and arms to permit a pair of pin members 65 to be received therein in a generally upright manner, and in this way the implement support assembly is pivotally and conveniently removably secured to the front of the push frame assembly.

It is also apparent that a pair of forwardly diverging and substantially horizontally oriented actuators or hydraulic angling jacks 64 are disposed between a pair of pivot joints 66 secured to the opposite sides of the rear of the box beam 44 and a pair of pivot joints 68 secured to the rear face of a body portion 70 of the implement support assembly 60. When the jacks 64 are intermediately extended to the same length as shown in FIG. 4, the body portion is usually oriented transversely with respect to the normal direction of vehicle travel.

In accordance with another feature of the implement mounting arrangement 12, an implement or blade assembly 72 is mounted for sideways movement on the implement support assembly 60. As best shown in FIG. 3, this is accomplished by providing an upper transversely extending socket or U-shaped bearing assembly 74 and a lower bearing assembly 76, including a front bearing 78 and a rear bearing 80 parallel thereto, on the front of the body portion 70. In addition, an upper main rail member 82 extends rearwardly across the back of the blade assembly and is slidably secured within the upper bearing assembly, while a lower floating rail member 84 is slidably disposed between the bearings of the lower bearing assembly.

Figure 4:
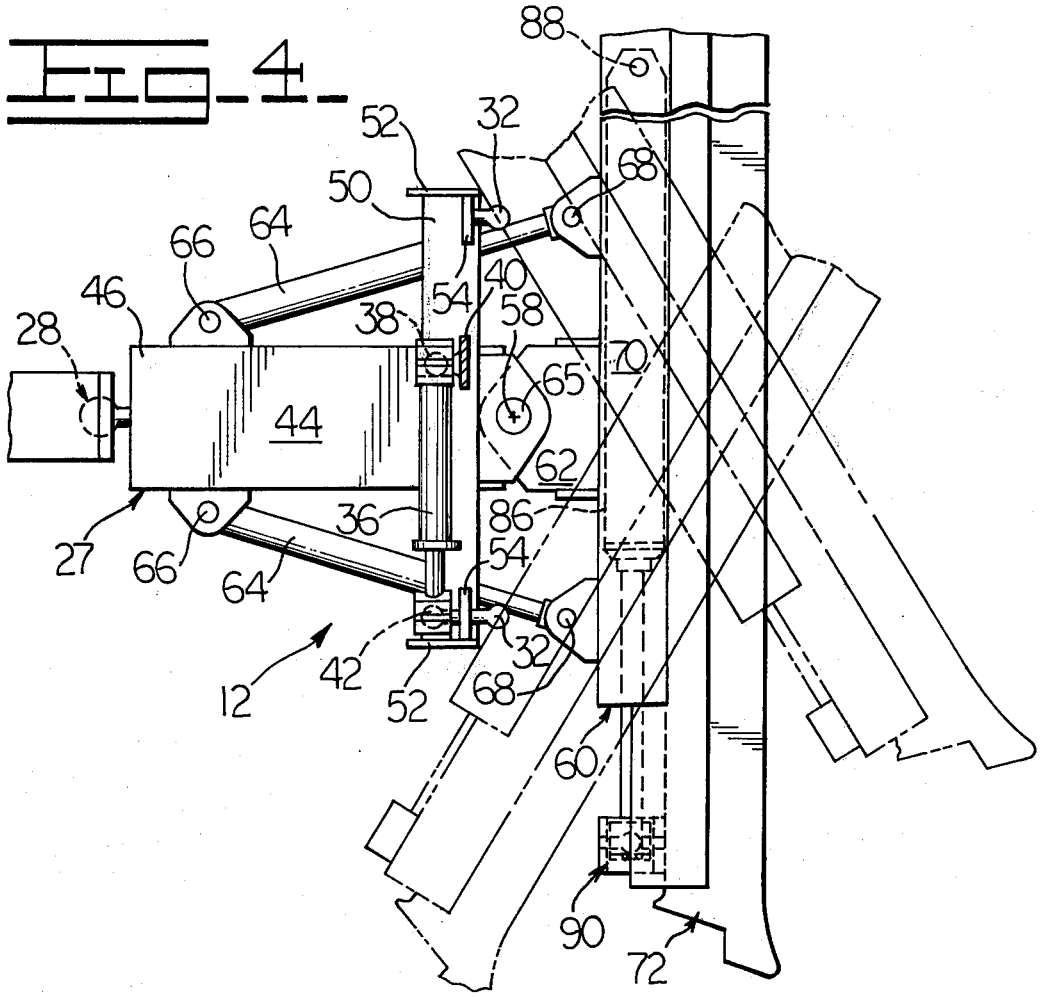
FIG. 4 is a diagrammatic and fragmentary top plan view of FIG. 3 with certain portions omitted for illustrative convenience.

In order to provide for selectively side shifting the blade assembly 72 on the support assembly 60, one end of an actuator or hydraulic side shifting jack 86 is secured to the body portion 70 as shown diagrammatically in FIG. 4 at an anchoring joint 88, and with the other end thereof secured to the blade assembly at a rearwardly extending bracket joint 90.

OPERATION

While the operation of the present invention is believed clearly apparent from the foregoing description, further amplification will subsequently be made in the following brief summary of such operation. In general, fine grading of earth can be achieved with the implement mounting arrangement 12 disposed in a horizontal attitude and with the lifting jacks 30 generally equally extended as may be visualized with reference to FIG. 3. With further extension of these jacks, the blade assembly is lowered arcuately, but in a generally horizontal transverse attitude about the universal connection 28 so that additional cutting of the earth can be achieved. Incidentally, it is to be appreciated that such increased forces are advantageously transferred rearwardly into the main frame 26 as mentioned previously above, and to the structurally stronger rear portion 16 of the motor grader 10.

It is also apparent that the mounting arrangement 12 can be tilted relative to the main frame 26 by simultaneously extending one of the lifting jacks 30 and retracting the other one. For example, extending the right lifting jack will rotate the pivot joint 32 downwardly and in a clockwise direction in a generally transverse upright plane when viewed from the operator's station 24. Of course, this results in a corresponding tilting of the implement support assembly 60 and the blade assembly 72. Consequently, the right side of the blade assembly is caused to penetrate more deeply into the earth. If desired, the left side of the blade assembly may be correspondingly oppositely adjusted for cutting earth more deeply than the right side.

During lowering, raising, or tilting of the blade assembly 72, it is to be appreciated that the stabilizing jack 36 is disposed in a floating mode of operation, but upon reaching a desired holding position of the lifting jacks 30 the stabilizing jack is also placed into a rigid holding position. This permits the effective transmission of transverse working loads from the forward end of the push frame assembly 27 into the bracket 40 and the main frame 26. When actuated, however, the jack 36 is further able to pivot the push frame assembly about the universal connection 28, as may be best visualized with reference to FIG. 4. For example, extension of the stabilizing jack will rotate the push frame assembly in a clockwise direction when viewing the drawing, so that it may be offset to the right when viewed from the operator's station 24, and thus will provide greater reach to that side.

The operation of the angling jacks 64 can also be appreciated by making reference to FIG. 4, wherein these jacks are shown equally extended to place the implement support assembly 60 in a position substantially at a right angle to the box beam 44, or normal to the general longitudinal orientation of the push frame assembly 27. Retraction of the right jack and simultaneous extension of the left jack will rotate the support assembly clockwise when viewing the drawing about the pivot axis 58 to the position shown in phantom. With this orientation of the blade assembly 72, earth may be cut and rolled angularly rearwardly and rightwardly away from the side thereof as the motor grader 10 travels in a longitudinal direction of travel. Of course, it is to be realized that the angling jacks may be adjusted in an opposite manner to roll earth to the left side as is indicated by the other phantom outline thereof.

Still further, it is apparent that the blade assembly 72 can be side shifted to either side of the motor grader 10 by appropriate operation of the side shifting jack 86. Specifically, if this jack is extended, the blade assembly is side shifted on the support assembly 60 to the right or downwardly when viewing FIG. 4. This provides a greatly extended reach to the right beyond the wheels 18 and 20, and is extremely useful in road edge finishing operations. Again, it is clear that the blade assembly may also be shifted to the left with retraction of the side shifting jack.

In view of the foregoing, it is readily apparent that while the heavy duty implement mounting arrangement 12 of the present invention can be effectively adjusted to many working attitudes, it is advantageously compact because it does not utilize a conventional circle and associated rotary drive mechanism. Particularly, its overall length or the distance between the universal connection 28 and the front of the blade assembly 72 is relatively short so that the distance between the front wheels 18 and rear wheels 20 can remain short. Alternately, the available space between the blade assembly and front wheels could be utilized for a ripper arrangement pivotally coupled to the front portion 14 of the frame, although not shown. Moreover, the push-type construction of the arrangement, including the high load bearing capacity of the hinge joints 56, the arms 62, the pin members 65, and the angling jacks 64, effectively allows transfer of high forces directly rearwardly into the heavier rear portion 16 of the motor grader. This permits a lighter main frame 26 to be utilized forwardly of the universal connection 28.

While the invention has been described and shown with particular reference to a preferred embodiment, it will be apparent that variations might be possible that would fall within the scope of the present invention, which is not intended to be limited except as defined in the following claims.

What is claimed is:

1. An implement mounting arrangement, operatively associated with a longitudinally oriented main frame of a vehicle, comprising:

a base frame assembly having an inner end and an outer end and being universally secured at said inner end to said main frame;

first actuator means interconnected between said main frame and said outer end of said base frame assembly for suspended raising, lowering and tilting thereof;

an implement support assembly hingedly mounted on said outer end of said base frame assembly;

angling means interconnected between said base frame assembly and said implement support assembly for angling it relative to the direction of travel of the vehicle; and second actuator means interconnected between said main frame and said outer end of said base frame assembly for stabilizing and side shifting said base frame assembly.

2. The implement mounting arrangement of claim 1 wherein said base frame assembly includes a generally longitudinally extending box beam, said arrangement including a universal ball and socket connection coupling said box beam to said main frame.

3. The implement mounting arrangement of claim 2 wherein said base frame assembly includes a generally transversely extending cross arm connected to said box beam, and said first actuator means includes a pair of generally upright actuators connected between said main frame and the opposite ends of said cross arm.

4. The implement mounting arrangement of claim 3 wherein said second actuator means includes a generally transversely oriented actuator connected between said main frame and said cross arm.

5. The implement mounting arrangement of claim 4 wherein said upright actuators and said transversely oriented actuator are jacks, said jacks being of a construction sufficient for extending, retracting and holding operation.

6. The implement mounting arrangement of claim 1 wherein said second actuator means is a fluid operated jack, said jack being oriented generally transversely with respect to said main frame.

7. The implement mounting arrangement of claim 1 including an implement assembly connected to said support assembly and third actuator means for side shifting said implement assembly on said support assembly.

8. The implement mountng arrangement of claim 1 including an implement connected to said support assembly and wherein said vehicle is a motor grader, said motor grader being of a construction sufficient for pushing said base frame assembly, said support assembly and said implement during forward movement thereof.

* * * * *